US005116230A

United States Patent [19]

Dechelette et al.

[11] Patent Number: 5,116,230

[45] Date of Patent: May 26, 1992

[54] COAXIAL CABLE CONNECTOR

[75] Inventors: Helen Dechelette, Wissous, France; David L. Brunker, Naperville, Ill.

[73] Assignee: Molex Incorporated, Lisle, Ill.

[21] Appl. No.: 682,818

[22] Filed: Apr. 9, 1991

[51] Int. Cl.[5] ..... H01R 13/648

[52] U.S. Cl. ..... 439/101; 439/394; 439/610

[58] Field of Search ..... 439/101, 395, 413, 497, 439/607-610, 426

[56] References Cited

U.S. PATENT DOCUMENTS 3,587,028 6/1971 Uberbacher ..... 439/101
4,611,867 9/1986 Ichimura et al. ..... 439/608 X
4,632,486 12/1986 Hasircoglu ..... 439/394

FOREIGN PATENT DOCUMENTS 2124041 2/1984 United Kingdom ..... 439/394

*Primary Examiner*—Eugene F. Desmond
*Attorney, Agent, or Firm*—A. A. Tirva; Charles S. Cohen

[57] ABSTRACT

A connector assembly for terminating a shielded insulated wire having a conductor core with a sheath of insulation therearound, an outer insulating jacket and a shield between the sheath and the jacket. The assembly includes a dielectric housing mounting an electrically conductive signal terminal for termination to the conductor core of the wire. A conductive grounding terminal is disposed outside the dielectric housing and has an insulation piercing section for displacing the outer insulating jacket of the wire to engage the shield thereof, in response to the application of a force on the grounding terminal generally parallel to the longitudinal axis of the wire. The assembly is applicable for terminating a series of shielded insulated wires, with a plurality of conductive separator plates insert molded to the dielectric housing and individually disposed between adjacent individual signal terminals. When the assembly terminates a plurality of shielded insulated wires, the grounding terminal is a unitary component having shielding portions along two opposite sides of the signal terminals, with the separator plates along the other opposite sides of the signal terminals.

21 Claims, 8 Drawing Sheets

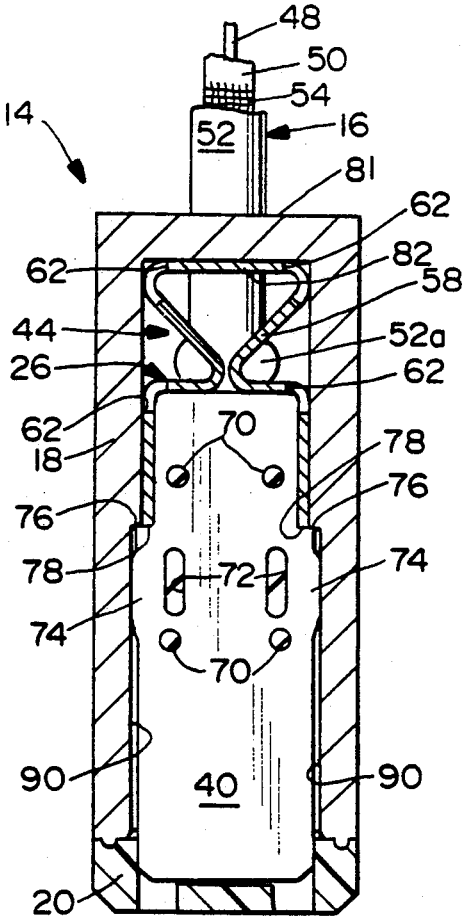
FIG.5
FIG.6
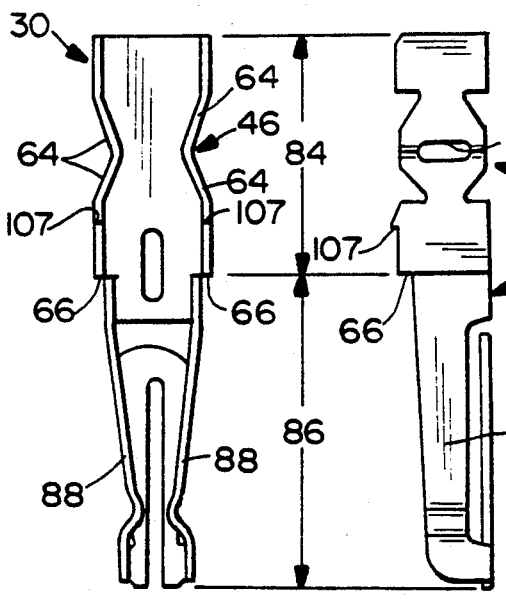
FIG.7
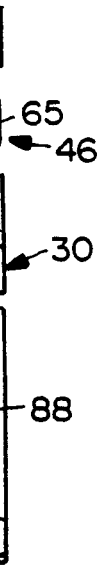
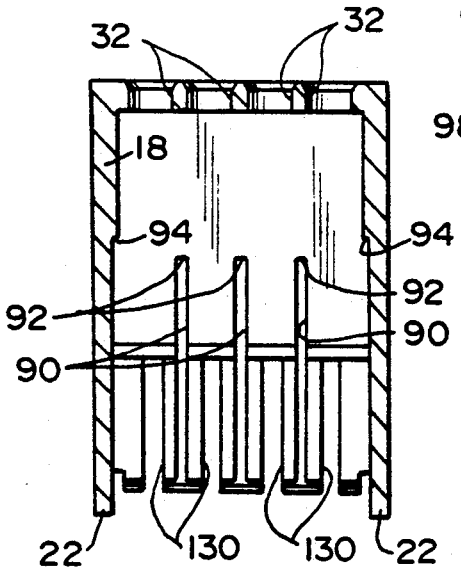
FIG.8
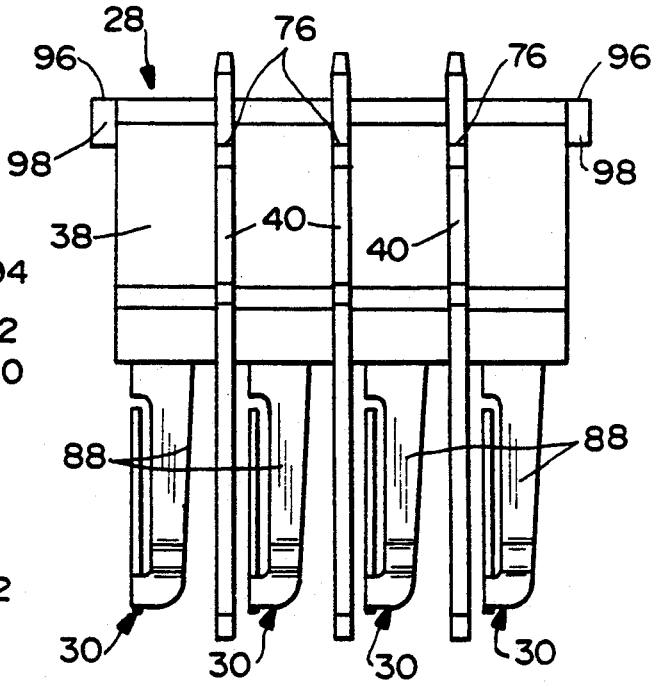
FIG.9

28
100
30

26
102

100
30
18
102
26

COAXIAL CABLE CONNECTOR

FIELD OF THE INVENTION

This invention generally relates to the art of electrical connectors and, particularly, to a shielding and grounding electrical connector assembly, such as for use with coaxial cables.

Shielded insulated wires or coaxial cables have a conductor core with a sheath of insulation therearound, an outer insulating jacket and a shield means, such as a braid or foil, between the sheath and the jacket. Coaxial cables of the character described are becoming increasingly miniaturized and commonly are termed "microcoaxial" cables and are used for high speed signal applications. For instance, a 50 ohm microcoaxial cable may have an outside diameter on the order of 1.9 mm which can be terminated on a 2.5 mm pitch either in a single row or a multi-row configuration. Contacts terminated to the cores of such cables are mated to compliant pins fixed in a plane of a 2.5 mm grid array.

Such microcoaxial cable and connector systems are available with the cables terminated to their respective contacts by crimping or soldering termination techniques. A problem with such techniques is that they require considerable time in preparing the cables, such as exposing the braided or foil shield means, as well as terminating the cables to their respective contacts. Termination tooling for such applications normally require several tools to carry out the completed terminating and grounding operations. Other problems involve discrepancies between the electrical potential between separate cable/contacts, and "crosstalk" may occur between any members of a multi-cable system at different electrical potentials.

This invention is directed to solving the above problems by providing a connector assembly which eliminates crimping or soldering termination techniques, which requires less cable preparation than prior art techniques, which requires much simpler application tooling, and which substantially reduces crosstalk.

SUMMARY OF THE INVENTION

An object, therefore, of the invention is to provide a new and improved connector assembly for terminating a shielded insulated wire or coaxial cable and which is readily applicable for high speed signal applications utilizing impedance controlled microcoaxial cables.

As is known, a coaxial cable includes a conductor core with a sheath of insulation therearound, an outer insulating jacket and a shield means, such as a braid or foil, between the sheath and the jacket. The invention contemplates a connector assembly for terminating such a coaxial cable or shielded insulated wire. The connector assembly includes dielectric means mounting an electrically conductive signal terminal for termination to the conductor core of the insulated wire. Conductive grounding terminal means are mounted in the assembly outside the dielectric means and includes piercing means for displacing the outer insulating jacket of the wire to engage the shield means thereof. In the preferred embodiment, the piercing means is structured to displace the insulating jacket upon application of a force on the grounding terminal means generally parallel to the longitudinal axis of the wire.

The invention also contemplates a unique combination wherein the signal terminal has at least one deflectable wall portion for displacing the sheath of the wire to terminate the conductor core, also upon application of a force directed generally parallel to the longitudinal axis of the wire, whereby the wire can be both grounded and terminated in response to application of those axial forces by very simple application tooling.

The connector assembly of the invention is readily applicable for multi-wire termination. Specifically, the dielectric means can be formed to mount a plurality of signal terminals for termination to the conductor cores of a plurality of insulated wires. A plurality of conductive separator plates are fixed to the dielectric means and individually disposed between adjacent individual terminals. The separator plates provide means for reducing crosstalk in the connector. Preferably, the dielectric means is a molded component, and the separator plates are insert molded in the component. In addition, the separator plates have portions exposed exteriorly of the dielectric means for engagement with the grounding terminal means. Still further, the grounding terminal means may comprise a unitary component including a plurality of the piercing means for displacing the outer insulating jackets of the plurality of wires, thereby providing a ground for all of the wires at or near the same electrical potential. The grounding terminal means also has shielding arms juxtaposed outside the signal terminals along two opposite sides thereof, with the separator plates being disposed along the other opposite sides of the signal terminals.

A shield or outer housing is disposed about the dielectric means and conductive grounding terminal means. The shield may be a die cast component of zinc, a copper alloy or the like. The shield engages the conductive grounding terminal means as well as the separator plates and acts as an abutment means to facilitate termination of the connector assembly by appropriate application tooling.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 5 is a vertical section taken generally along the line 5—5 of FIG. 1;

FIG. 6 is a front elevational view of one of the signal terminals mounted in the connector assembly;

FIG. 7 is a side elevational view of the signal terminal of FIG. 6;

FIG. 8 is a vertical section, similar to that of FIG. 3, with all of the interior components removed to illustrate the interior configuration of the outer housing or shield;

FIG. 9 is a front elevational view of the inner dielectric housing including the signal terminals mounted therein and including the separator plates between the terminals;

DETAILED DESCRIPTION OF THE PREFERRED EMBODIMENT

Figure 1:
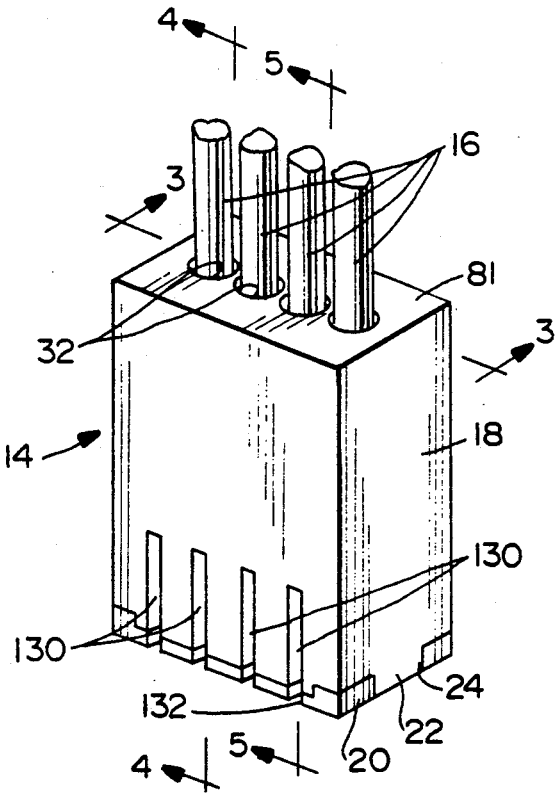
FIG. 1 is a perspective view of a connector assembly of the invention, for terminating a plurality of shielded insulated wires or coaxial cables.

Referring to the drawings in greater detail, and first to FIG. 1, the invention is incorporated in an electrical connector assembly, generally designated 14, for electrically terminating and groundingly terminating one or more insulated wires or microcoaxial cables, generally designated 16.

The connector assembly is shown fully assembled in FIG. 1 and, consequently, only an outer housing or shield 18 and a lower mating connector entry cap 20 are visible.

Figure 2:
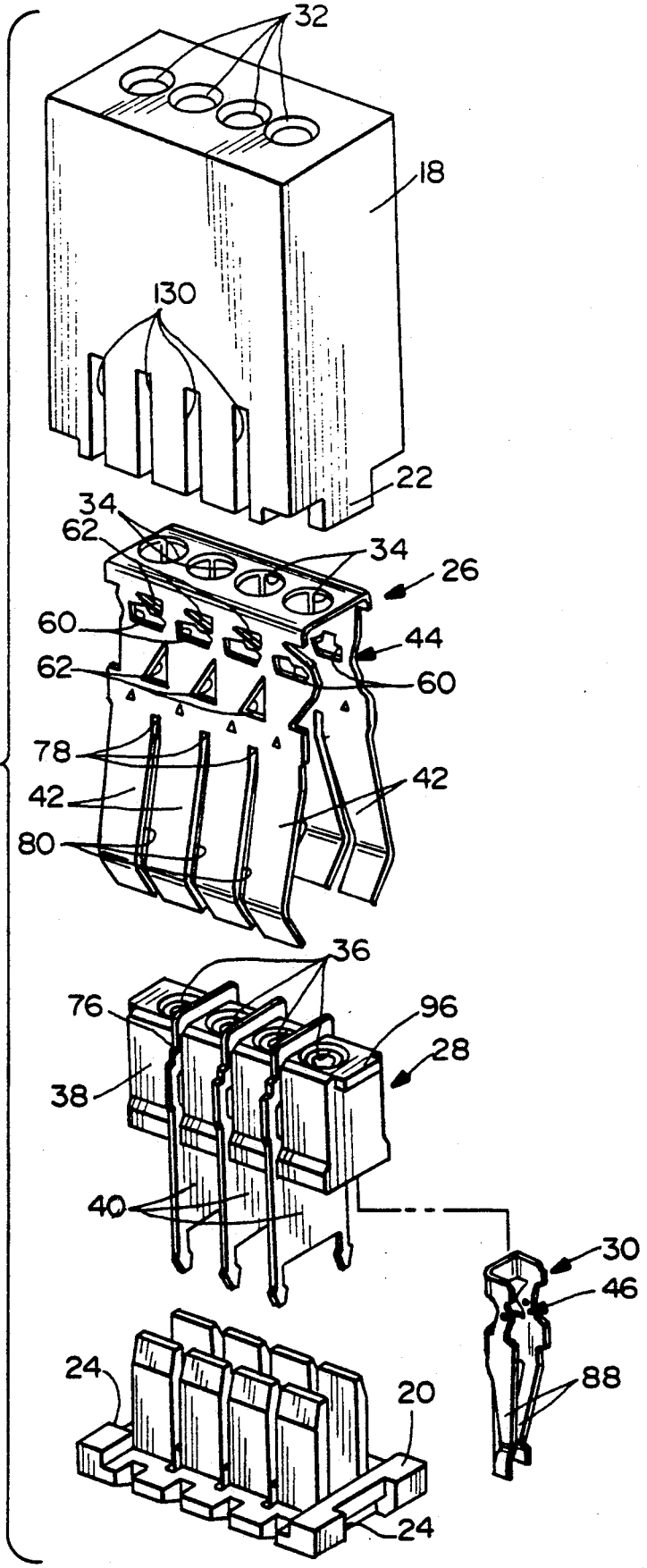
FIG. 2 is an exploded perspective view of the major components of the connector of FIG. 1.

FIG. 2 shows the major components of electrical connector assembly 14 (with coaxial cables 16 not shown). More particularly, outer housing 18 is shown at the top of the depiction and lower entry cap 20 at the bottom of the depiction, with the other components located therebetween to facilitate the illustration, the other components being assembled substantially within outer housing 18. The outer housing comprises a shield for the connector assembly and, preferably, is a molded component of zinc, a copper alloy or the like by die casting techniques. The housing alternatively could be fabricated by folding, pressing or other techniques. Entry cap 20 is unitarily molded of dielectric material, such as plastic. The outer housing has a pair of tabs 22 formed at opposite ends of the bottom of the housing for locating in recesses 24 at opposite ends of entry cap 20. In final assembly, the tabs are crimped inwardly to secure the entry cap to the outer housing. The entry cap protects the mating ends of signal terminals within housing 18, as will be seen below.

FIG. 2 also shows a grounding terminal, generally designated 26, a signal module, generally designated 28, and a metal signal terminal, generally designated 30, all of which are assembled together, as described hereinafter, within outer housing 18. It should be noted that only one signal terminal 30 is shown in FIG. 2, but there will be four terminals, one for termination to the conductor cores of each of the four coaxial cables 16. To that end, it can be seen that outer housing 18 has four cable entry holes 32, grounding terminal 26 has four cable through holes 34 and signal module 28 has four through holes 36 defining cavities for terminals 30. The through holes 36 in signal module 28 are molded in a dielectric inner housing means 38 within which signal terminals 30 are mounted, as described hereinafter.

Three grounding separator plates 40 are insert molded in inner dielectric housing means 38 and are disposed between signal terminals 30. Grounding terminal 26 is a single member which grounds the internal shielding means of all of the coaxial cables 16. Consequently, all of the shields are maintained at or near the same electrical potential, as will be evident hereinafter. Grounding terminal 26 also includes shielding means juxtaposed outside of signal terminals 30. Specifically, four pairs of depending arms 42 extend lengthwise along two opposite sides of the respective terminals. With the arms being disposed on two opposite sides of the signal terminals, and with separator plates 40 being disposed between adjacent signal terminals, the terminals are surrounded by shielding members on all sides, including the end-most terminals being shielded on the outsides thereof by the end walls of outer housing 18 which forms an additional shield for the entire connector assembly.

Still referring to FIG. 2, it should be understood that the invention contemplates a unique arrangement whereby grounding terminal 26 is terminated to the shields of all of the coaxial cables, and signal terminals 30 are terminated to the conductor cores of respective ones of the cables in response to forces directed generally parallel to the longitudinal axes of the cables. This will be described in greater detail hereinafter. However, suffice it to say at this point that grounding terminal 26 has piercing means, generally designated 44, for piercing the outer insulating jacket of the coaxial cables, and signal terminals 30 having piercing means, generally designated 46, for piercing the insulating sheaths about the inner conductor cores of the signal terminals. It further should be understood at this point that, although the invention is shown in most of the drawings as incorporated in an electrical connector assembly for terminating four coaxial cables in a row, most facets of the invention are equally applicable for other configurations of connector assemblies for simultaneously mass terminating one or more cables in one or more rows thereof.

Figure 4:
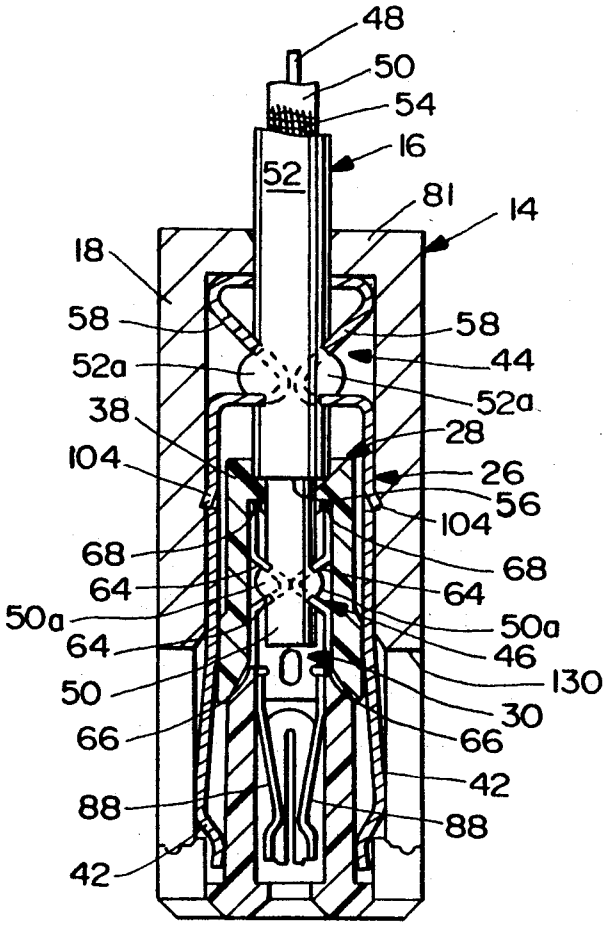
FIG. 4 is a vertical section taken generally along the line 4—4 of FIG. 1.
Figure 3:
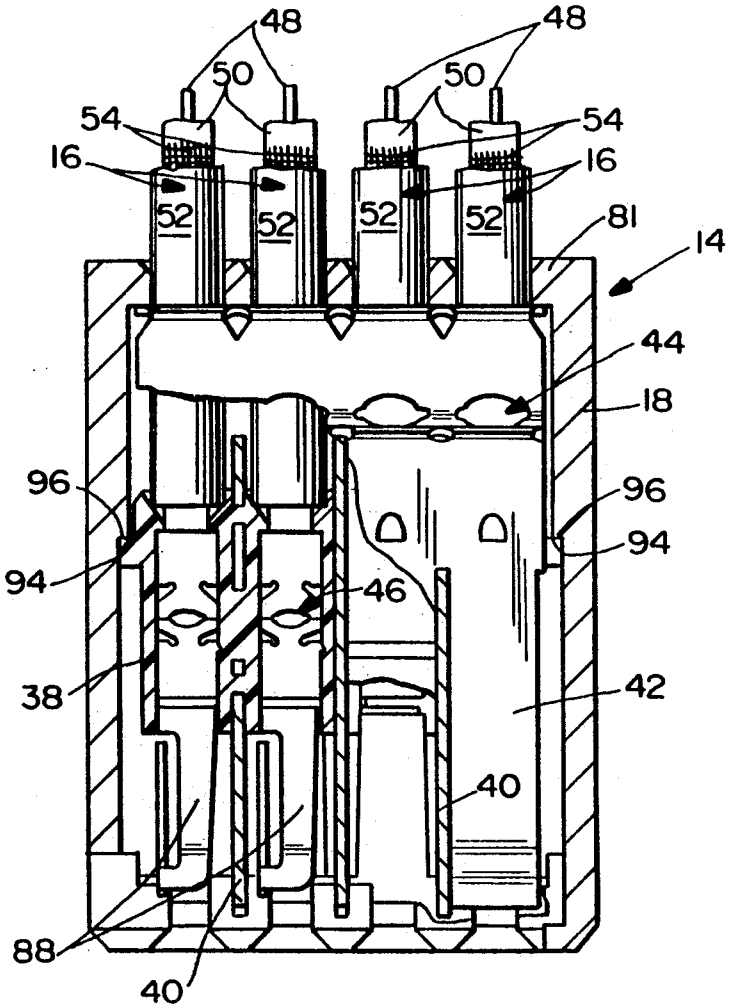
FIG. 3 is a vertical section taken generally along line 3—3 of FIG. 1.

FIGS. 3–5 are vertical sections through connector assembly 14 at various locations as described above in the Brief Description Of The Drawings. It can be seen that each coaxial cable 16 has a conductor core 48 with a sheath of insulation 50 therearound, an outer insulating jacket 52 and a shield means 54, such as a braid or foil, between the sheath 50 and the jacket 52. Heretofore, in preparing a coaxial cable for termination in a connector assembly, outer jacket 52 normally is stripped to a given length to expose shield 54, and the shield is wrapped back over the jacket for termination to a ground terminal, as by crimping. Most often, sheath 50 also is stripped to expose a distal end of conductor core 48 for termination to an appropriate signal terminal. As can be seen in FIG. 4, those preparation steps are significantly reduced by the insulation displacement concepts of the invention. Specifically, it can be seen in FIG. 4 that outer jacket 52 (along with shield 54) has been cut back, as at 56, simply to expose a given length of insulating sheath 50 without exposing any length of the conductor core nor any length of the shield. Therefore, the shield is not wrapped back onto the outer insulating jacket.

As described in greater detail hereinafter, piercing means 44 of grounding terminal 26 displaces the insulation 52*a* of outer jacket 52 to terminate the grounding terminal with the shield means inside the jacket. Piercing means 46 of each signal terminal 30 displaces insulation 50*a* of sheath 50 to terminate signal terminal 30 with conductor core 48 within the insulating sheath. This termination of the core and the shield of the coaxial cable is accomplished upon application of forces on grounding terminal 26 and signal terminals 30 generally parallel to the longitudinal axes of cables 16, as described in greater detail hereinafter.

Figure 14:
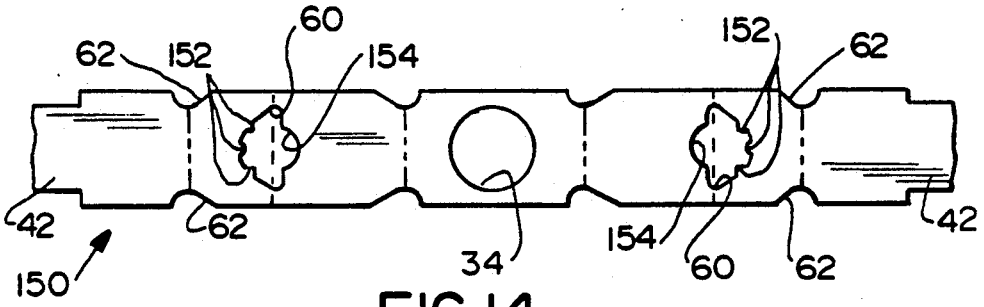
FIG. 14 is a top plan view of the blank layout for a portion of the ground terminal utilized with the present invention.

As seen in FIGS. 4 and 5, piercing means 44 of grounding terminal 26 is formed by a pair of inwardly directed piercing sections 58 which are generally V-shaped. Referring back to FIG. 2 in conjunction with FIGS. 4 and 14, cut-outs 60 are stamped out of the grounding terminal generally at the apex of the V-shaped piercing sections. These cut-outs facilitate piercing the insulating material of jacket 52. FIGS. 2 and 14 also shows triangular cut-outs 62 which simply are provided for facilitating forming piercing sections 58 in V-shapes uniformly along the length of grounding terminal 26. FIG. 14 shows a blank layout 150 corresponding to the portion of ground terminal 26 that will pierce jacket 52 in order to terminate one shield 54 of one coaxial cable 16. On one half, each cut-out 60 can include three equally spaced, rounded fingers 152 that project into cut-out 60 and displace the outer jacket 52 of the coaxial cable to terminate shield 54. The other half of each cut-out 60 includes a semi-circular portion 154 dimensioned to support the outer jackets 52 during termination without the semicircular portion 154 piercing the jacket. Such design is extremely effective to permit displacement of outer jacket 52 with no or only minimal distortion of insulating sheath 50 which surrounds core 48.

Referring back to FIG. 4, piercing means 46 of each signal terminal 30 similarly is formed by opposed, generally V-shaped piercing sections 64 for piercing the insulating material of sheath 50. Cut-outs 65 are provided for facilitating piercing the insulating material. For purposes described in greater detail, it also should be noted that signal terminal 30 has a pair of downwardly facing shoulders 66, and the upper end of each signal terminal abuts against downwardly facing shoulders 68 of inner dielectric housing 38 of signal module 28.

As stated above, signal terminals 30 (except those at the ends of the rows) are substantially shielded within the connector assembly, notwithstanding the fact that the entire connector assembly is substantially surrounded by die cast housing 18. More particularly, it can be seen in FIG. 4 how arms 42 of grounding terminal 26 cover the entirety of opposite sides of each signal terminal. FIG. 5 shows the configurations of grounding separator plates 40, and it can be seen that the separator plates substantially cover the sides of the signal terminals opposite the sides covered by arms 42 of the grounding terminal.

Continuing to refer to FIG. 5, as stated above, grounding separator plates 40 are insert molded into inner housing 38 during the forming of signal module 28. It can be seen how the molded material of the housing flows through holes 70 and vertically elongated slots 72 in the separator plates. Whereas holes 70 simply are stamped out of the metal of the plates, slots 72 are stamped on a bias so that metal is displaced outwardly to form nibs 74 projecting outwardly for secure engagement of the grounding separator plates with outer die cast housing 18. Alternatively, nibs 74 could be stamped in the final shape of plates 40, as shown, without displacing any metal while stamping slots 72. Holes 70 and slots 72 are provided to allow plastic material to flow through the separator plates, thereby allowing module housing 38 and the entire module 28 to be fabricated as a unitary part. Slots 72 also provide flexibility for nibs 74 when they engage within slots 90 of housing 18. It also should be noted that each separator plate is provided with a pair of upwardly facing shoulders 76 which engage the bottoms 78 of slots 80 (FIG. 2) between arms 42 of grounding terminal 26. This interengagement between the separator plates, at shoulders 78, with the grounding terminal is oppositely directed to an interengagement between an end wall 81 of outer housing 18 and a top wall 82 of grounding terminal 26, for purposes described hereinafter.

FIGS. 6 and 7 show the configuration of each metal signal terminal 30 in a condition prior to being deformed to displace the insulation of sheath 50 of a respective coaxial cable. Each signal terminal can be divided functionally into a termination area 84 and a mating area 86. The termination area includes piercing means 46 formed by piercing sections 64 and cut-outs 65. Mating area 86 is provided by a pair of arms 88 which define a female contact or receptacle for receiving a mating signal pin of an appropriate mating connector. It can be seen that shoulders 66 are disposed between the termination and mating areas. The terminal is designed for displacing the insulation of the coaxial cable in response to or upon application of a force on the terminal generally parallel to the longitudinal axis thereof, i.e., the longitudinal axis of the coaxial cable. In essence, piercing sections 64 are inwardly deflectable wall portions of the signal terminal which are driven inwardly toward each other, through the insulation, in response to the longitudinally directed force. Terminals of this type are shown in U.S. Pat. Nos. 4,512,619 to Dechelette, dated Apr. 23, 1985, and 4,955,816 to Roberts et al., dated Sep. 11, 1990, both of which are assigned to the assignee of this invention and which are incorporated herein by reference.

FIG. 8 shows a vertical, longitudinal section through outer die cast housing 18 to specifically show that the interior side walls of the housing are provided with grooves 90 into which the side edges of grounding separator plates 40 are disposed, as also seen in FIG. 5. The inner ends of the grooves define stop shoulders 92 against which shoulders 76 (FIG. 5) of the separator plates abut. The housing also includes a pair of interior shoulders 94, one at each opposite end of the housing. Referring to FIG. 3 in conjunction with FIG. 8, shoulders 94 engage upwardly facing shoulders 96 formed at opposite ends of dielectric housing 38 of signal module 28.

FIG. 9 shows a side elevational view of signal module 28 to illustrate the relative spacing and separation of grounding separator plates 40 and signal terminals 30. It can be seen that the separator plates "cover" substantially all of the entire longitudinal extent of the signal terminals to provide shielding therebetween. This substantially reduces crosstalk between the signal terminals. Outwardly projecting stops 98 also are shown to define upwardly facing shoulders 96 for engaging downwardly facing shoulders 94 (FIG. 3) of outer housing 18.

FIGS. 10A–10F represent sequential steps in assembling and terminating connector assembly 14 (FIG. 1), illustrating the major components shown in FIG. 2. More particularly, signal terminals 30 are inserted into cavities 36 in housing 38 of signal module 28 having separator plates 40 insert molded therein, to provide a signal module subassembly 100 (i.e., 28 in FIG. 12). The signal terminals are retained within the signal module by an interference fit between retaining teeth 107 (FIG. 7) and the insulating material within the cavities of the module.

Figure 10E:
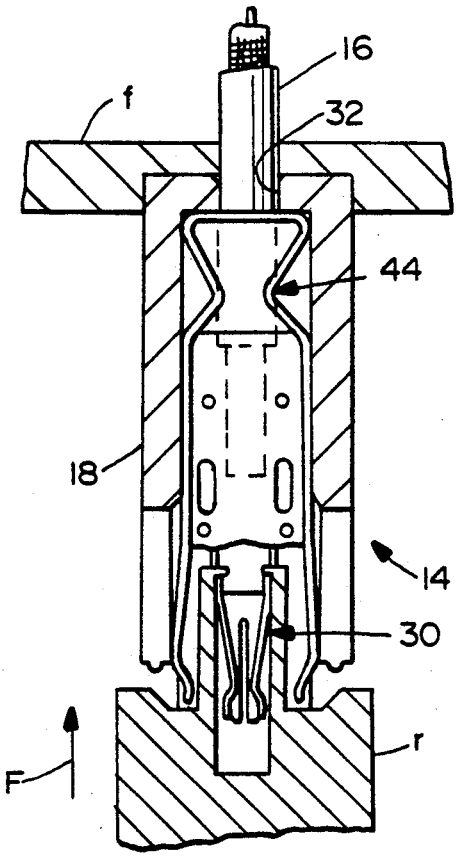
FIGS. 10A–10F represent sequential steps in the termination of the connector assembly illustrated in FIG. 1, and including the various components illustrated in the exploded depiction of FIG. 2, with certain parts removed for simplicity.
Figures 10A, 10B, 10C:
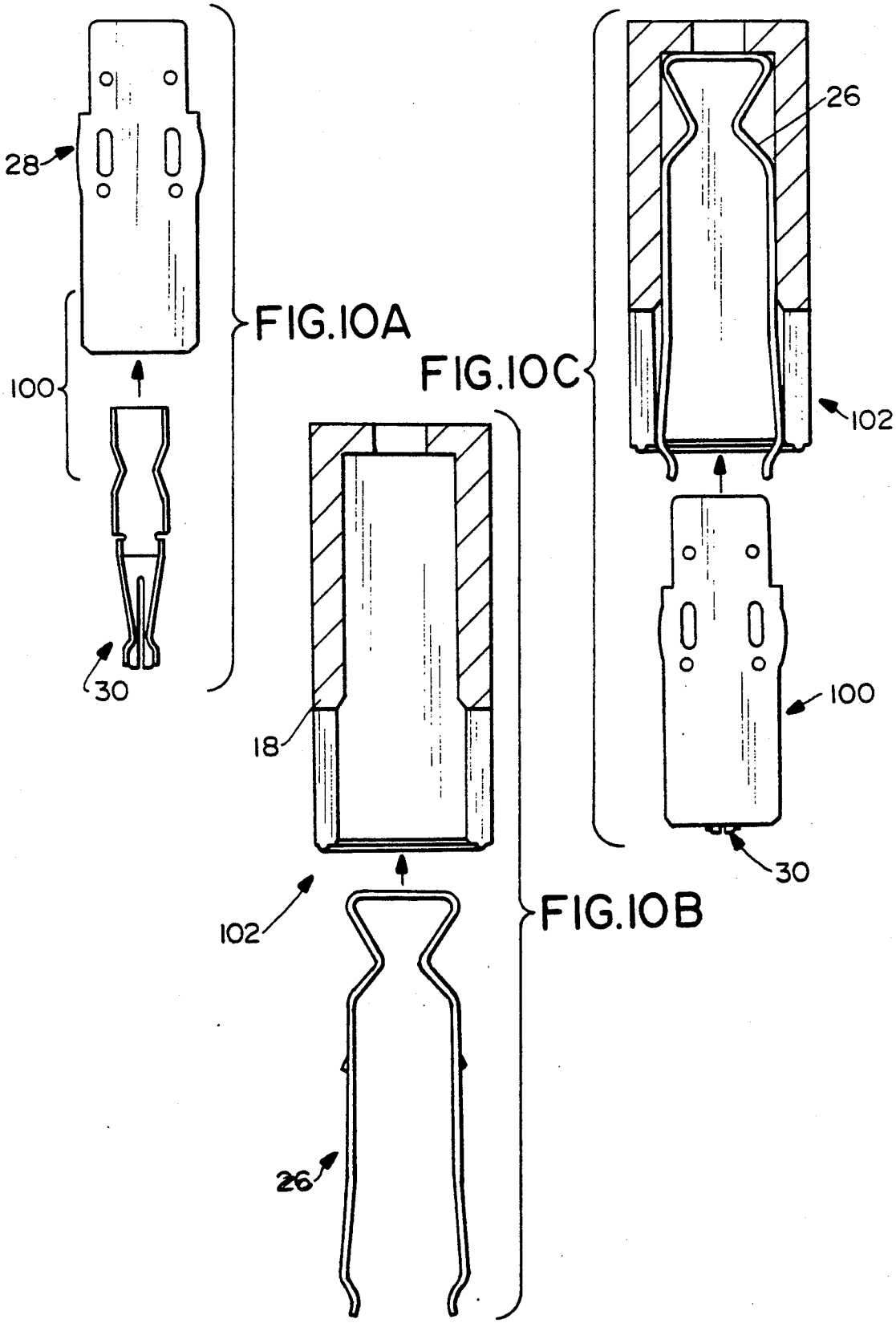
Figure 10D:
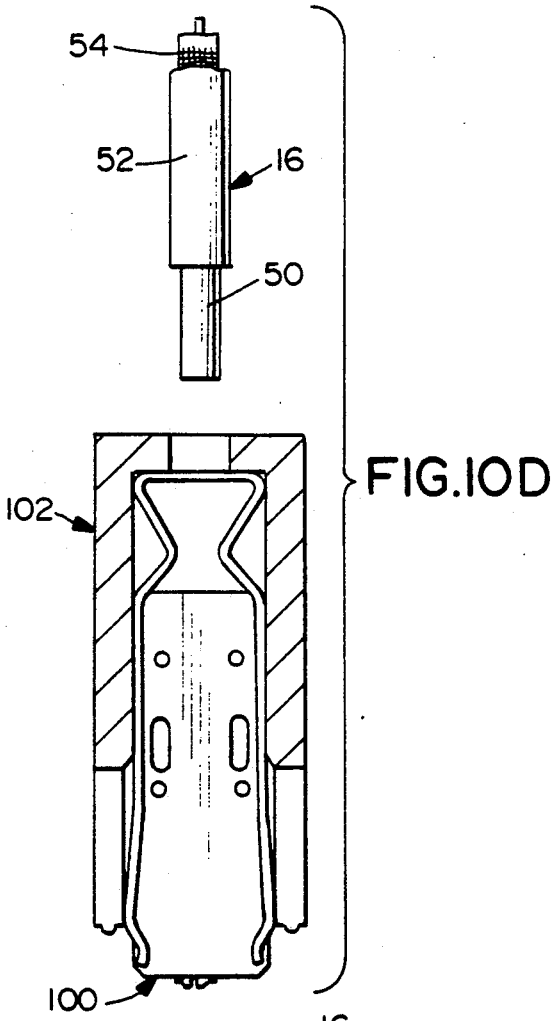
Figure 10F:
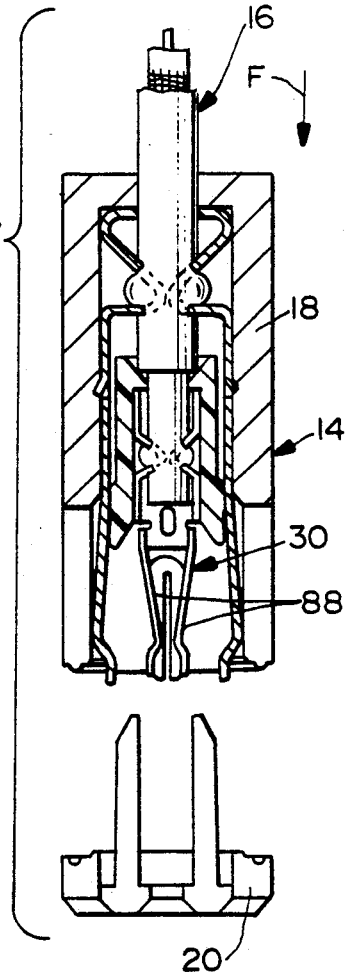

Referring to 10B, grounding terminal 26 is inserted into outer housing 18 to form a subassembly, generally designated 102 in FIG. 10C. The grounding terminal is held within the housing by teeth 104 (FIG. 4) which bite into the material of the interior walls of the housing.

Subassembly 100 then is inserted into subassembly 102 as shown in FIG. 10B and is held therein by a press-fit as best illustrated in FIG. 4. Coaxial cables 16 are prepared simply by stripping or cutting back outer jacket 52 and shield means 54, simultaneously, to expose a length of insulating sheath 50 having the conductor core therewithin. The core does not have to be exposed and the shield of the cable does not have to be exposed or stripped back onto the outside of outer jacket 52.

As seen in FIG. 10E, the coaxial cables then are inserted into the connector assembly 14, freely through holes 32 in the top of housing 18, to a position wherein outer jacket 52 is in registry with piercing means 44 of the grounding terminal and insulating sheath 50 is in registry with the piercing means of the signal terminals.

A force "F" (FIG. 10E) then is applied in a direction generally parallel to the longitudinal axis of the connector assembly, (i.e., generally parallel to the longitudinal axes of coaxial cables 16) whereupon the piercing means of the grounding terminal pierces insulating jacket 52 and the piercing means of the signal terminals pierce insulating sheath 50, thereby terminating both the shield means of the cable as well as the conductor core of the cable.

Lastly, mating connector entry cap 20 (FIG. 10F) is positioned into the bottom of connector assembly 14, as shown in FIGS. 3–5, and connector assembly 14 is ready for mating with a complementary connector assembly, particularly by receiving terminal pins from that assembly into the receptacle means defined by arms 88 of signal terminals 30. Entry cap 20 is secured in position by means of crimping tabs 22 on housing 18 and recesses 24 on the retaining cap, as described above in relation to FIGS. 1 and 2.

In order to perform the termination procedures by the axial forces described above, such as in relation to FIG. 10E, obviously the lower portions of grounding terminal 26 and signal terminals 30 or outer housing 18 must be fixed while force is exerted onto the other component. This can be done by various application tooling in conjunction with the various interconnections between the connector assembly components described above. Very generally, FIG. 10E shows a fixture "f" for fixedly engaging the top of outer housing 18. Ram means "r" drive the signal contacts and the grounding terminals upwardly, as by force "F", relative to the fixed housing.

Figure 11:
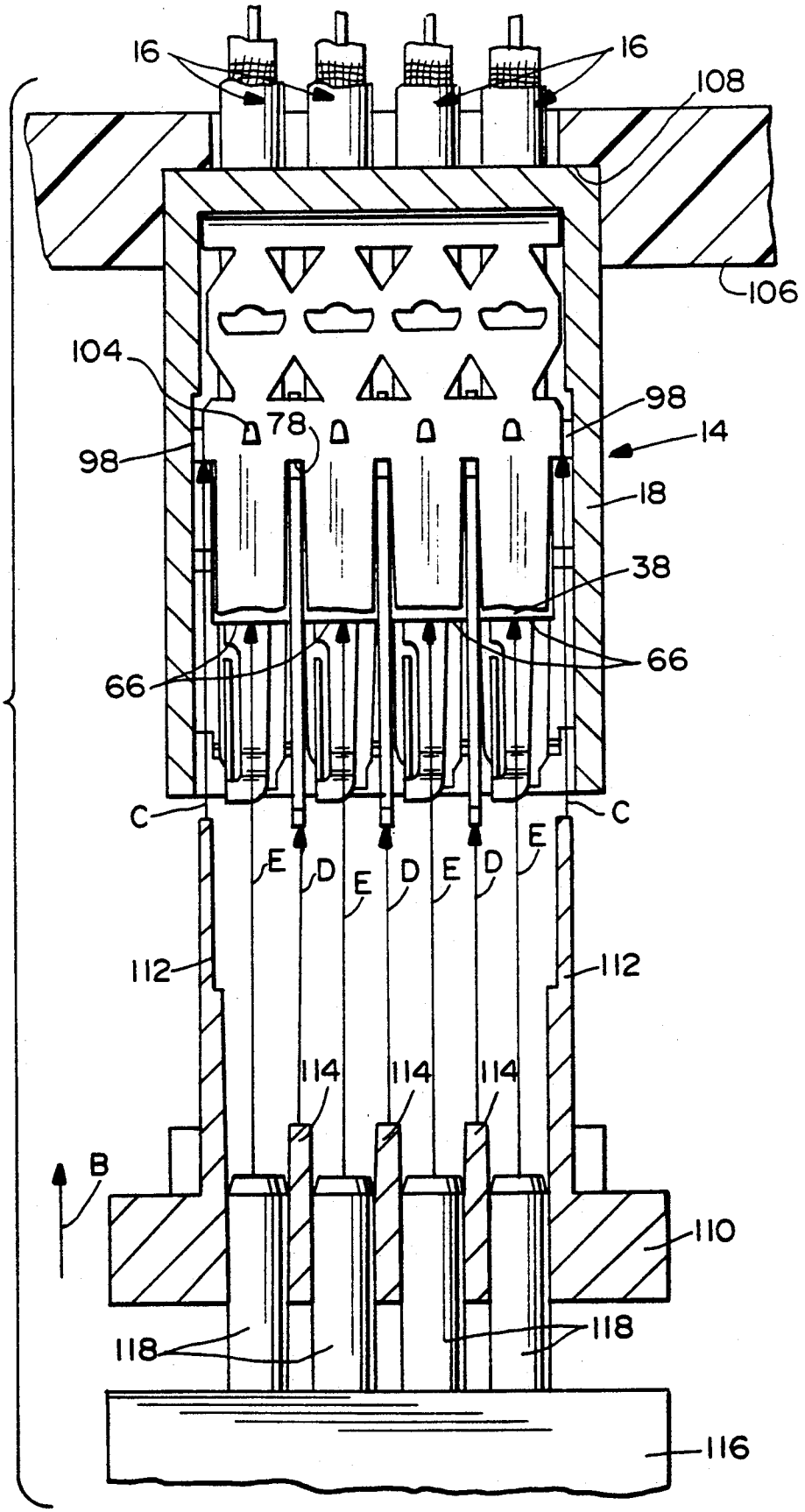
FIG. 11 is a somewhat schematic illustration of a type of application tooling which might be used to terminate the connector assembly.

More particularly, FIG. 11 shows somewhat schematically a tooling system which might be used. Specifically, the connector assembly, without entry cap 20 can be placed in a fixture schematically illustrated at 106 in FIG. 11 so that the top of outer housing 18 abuts against a shoulder 108 of the fixture. A first ram 110 has a pair of end fingers 112 and three intermediate fingers 114, and a second ram 116 has four fingers 118. As ram 110 is moved in the direction of arrow "B", fingers 112 and 114 move in paths as represented by arrows "C" and "D", respectively. Fingers 112 engage the bottoms of stops 98 of signal module 28 (FIG. 9) and fingers 114 engage the distal ends of grounding separator plates 40. Keeping in mind that the grounding plates are insert molded in housing 38 of the signal module, the module thereby is firmly engaged by the tooling of ram 110.

Referring to FIG. 5 in conjunction with FIG. 11, it can be seen that separator plates 40 engage grounding terminal 26 at shoulders 76 of the separator plates. Consequently, forces are applied to piercing means 44 of the grounding terminal by fixture 106 engaging the top of housing 18 which, in turn, engages the top of the grounding terminal. Opposing these forces in the opposite direction is the engagement of the grounding terminal by shoulders 76 of separator plates 40, while fingers 112 and 114 of ram 110 move against the separator plates.

Fingers 118 of ram 116 move in paths as represented by arrows "E" and engage shoulders 66 of signal contacts 30 as shown in and described in relation to FIGS. 4, 6, and 7. Opposing these forces in the opposite direction is the arrangement described above in relation to FIG. 4, wherein the tops of the signal terminals abut against shoulders 68 of signal module housing 38. Since the signal module will abut against outer housing 18 by interengaging shoulders 76 and 78 (FIG. 5) when piercing means 44 of the grounding terminal is deformed, and since outer housing 18 in turn abuts against fixture 104, movement of fingers 118 against shoulders 66 of the signal terminals will effect deformation of piercing means 46 of the terminals in response to the opposing forces longitudinally of the connector assembly as indicated by arrow "B" in FIG. 11. Preferably, rams 110 and 116 are sequentially moved by appropriate means so that the grounding terminal is deformed and terminated before the signal terminals are deformed and terminated.

Figure 12:
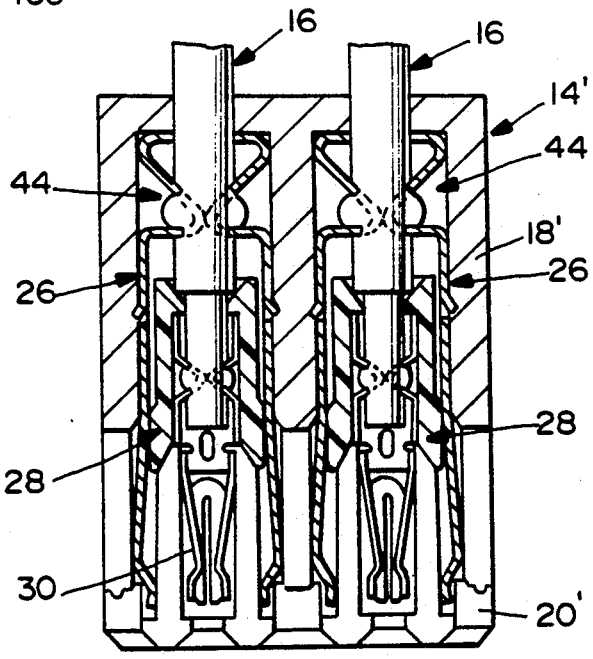
FIG. 12 is a vertical section through a connector assembly similar to that of FIG. 1, but showing an alternate embodiment wherein two rows of terminals and coaxial cables are terminated in the connector.

FIG. 12 shows an electrical connector assembly 14' having two longitudinal rows of coaxial cables terminated to respective signal terminals. This alternative connector assembly is illustrated simply so that it is understood that the concepts of this invention are equally applicable to connector assemblies for grounding and terminating one or more coaxial cables in a single row or in a multi-row array, or in practically any array depending upon the design parameters of the electrical connection system.

Figure 13:
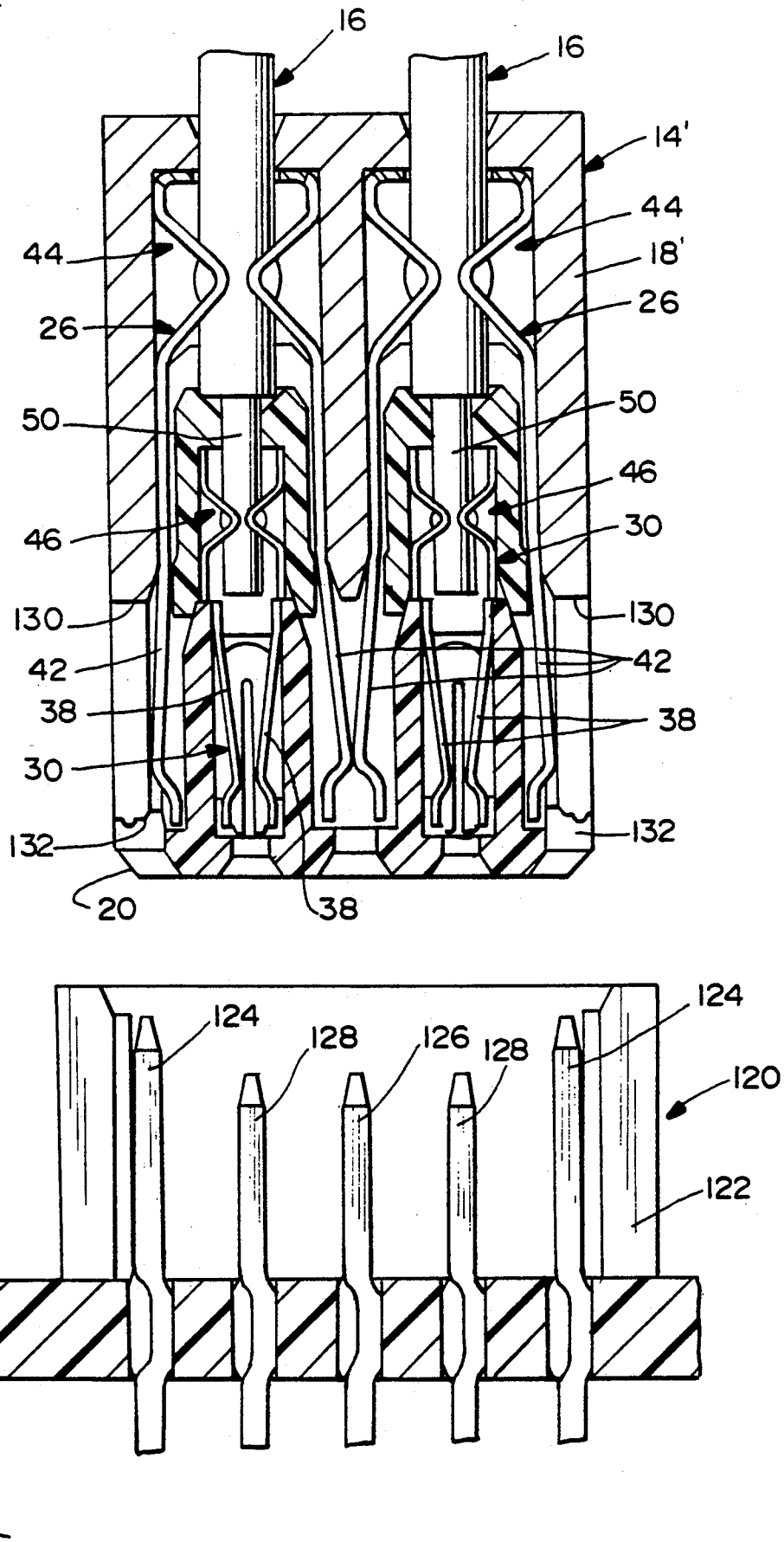
FIG. 13 is a somewhat schematic illustration of a complementary connector assembly, including grounding pins and terminal pins, for termination to the electrical connector assembly of the invention illustrated in FIGS. 1–12.

Lastly, FIG. 13 schematically illustrates a complementary connector assembly, generally designated 120, which may include a receptacle housing 122 mounting a pair of outside grounding pins 124, a center grounding pin 126 and a pair of signal pins 128 disposed alternatively between the grounding pins. This complementary connector can be mated with the two-row connector assembly 14' shown in FIG. 12. Signal pins 128 would be inserted into the female contact means provided by contact arms 38 of signal terminals 30. Outside grounding pins 124 would engage the outside arms 42 of the grounding terminals 26, and the center grounding pin 126 would be inserted between the adjacent inner arms 42 of the grounding terminals. Referring back to FIGS. 1, 4 and 8, in conjunction with FIG. 13, it can be seen that outer housing 18 is provided with slots 130 and entry cap 20 is provided with notches 132 for accommodating outside grounding pins 124.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A connector assembly for terminating a shielded insulated wire having a conductor core with a sheath of insulation therearound, an outer insulating jacket and a shield means between the sheath and the jacket, comprising:

dielectric means mounting an electrically conductive signal terminal for termination to the conductor core of the wire; and conductive grounding terminal means outside the dielectric means and having piercing means for displacing the outer insulating jacket of the wire to engage the shield means thereof wherein said grounding terminal means include shielding portions juxtaposed outside the signal terminal.

2. The connector assembly of claim 1 wherein said piercing means on the grounding terminal means for displacing the outer insulating jacket is structured to displace the insulating jacket upon application of a force on the grounding terminal means generally parallel to the longitudinal axis of the wire.

3. The connector assembly of claim 2 wherein said signal terminal has at least one deflectable wall portion for displacing the sheath of the wire to terminate the conductor core upon application of a force directed generally parallel to the longitudinal axis of the wire whereby the wire can be both grounded and terminated in response to application of said forces.

4. The connector assembly of claim 2, including a conductive shield about the dielectric means in conductivity with the grounding terminal means, the shield including abutment means for engaging the grounding terminal means to facilitate moving said piercing means to displace the insulating jacket in response to relative movement between the conductive shield and the grounding terminal means.

5. The connector assembly of claim 1 wherein said dielectric means mounts a plurality of signal terminals for termination to the conductor cores of a plurality of insulated wires, and including a plurality of conductive separator plates fixed to the dielectric means and individually disposed between adjacent individual signal terminals.

6. The connector assembly of claim 5 wherein said dielectric means is a molded component, and said separator plates are insert molded in the component.

7. The connector assembly of claim 6 wherein said separator plates have portions exposed exteriorly of the dielectric means in engagement with the grounding terminal means.

8. The connector assembly of claim 1 wherein said dielectric means mounts a plurality of signal terminals for termination to the conductor cores of a plurality of insulated wires, the grounding terminal means including a plurality of said piercing means for displacing the outer insulating jackets of the plurality of wires.

9. The connector assembly of claim 8 wherein said grounding terminal means comprises a unitary component having shielding portions juxtaposed outside the signal terminals.

10. The connector assembly of claim 1, including a shield about the dielectric means in conductivity with the grounding terminal means.

11. The connector assembly of claim 1 wherein said shielding portions comprises arms extending along two opposite sides of the signal terminal, and including a pair of conductive separator plates fixed to said dielectric means and disposed along the other opposite sides of the signal terminal.

12. The connector assembly of claim 11 wherein said dielectric means is a molded component, and said separator plates are insert molded in the component.

13. A connector assembly for terminating a series of shielded insulated wires, comprising:

dielectric means mounting a series of electrically conductive signal terminals for termination to conductors of said wires;

a plurality of individual conductive separator plates fixed to the dielectric means and individually disposed between adjacent ones of the terminals; and wherein said dielectric means is a molded component, and said separator plates are insert molded in the component.

14. The connector assembly of claim 13 including conductive grounding terminal means outside the dielectric means for engaging a shield means of the wire, the grounding terminal means including shielding portions juxtaposed on opposite sides of the signal terminal, with the separator plates disposed between the signal terminals along the other opposite sides thereof.

15. The connector assembly of claim 14 wherein said separator plates have portions exposed exteriorly of the dielectric means in engagement with the grounding terminal means.

16. The connector assembly of claim 15 wherein said grounding terminal means comprises a unitary component to provide a common electrical reference potential associated with all signal terminals.

17. A connector assembly for terminating a plurality of shielded insulated wires each having a conductor core with a sheath of insulation therearound, an outer insulating jacket and a shield means between the sheath and the jacket, comprising:

dielectric means mounting a series of electrically conductive signal terminals for termination to the conductors of the insulated wires;

a plurality of conductive separator plates fixed to the dielectric means and individually disposed between adjacent individual signal terminals; and conductive grounding terminal means outside the dielectric means for engaging the shield means of the insulated wires, the grounding terminal means being in conductive engagement with the separator plates.

18. The connector assembly of claim 17 wherein said grounding terminal means comprises a unitary component having shielding portions juxtaposed outside the signal terminals.

19. The connector assembly of claim 18 wherein said shielding portions comprise arms extending along two opposite sides of the signal terminals, and including a plurality of conductive separator plates fixed to said dielectric means and disposed along the other opposite sides of the signal terminals.

20. The connector assembly of claim 17 wherein said dielectric means is a molded component, and said separator plates are insert molded in the component.

21. The connector assembly of claim 17, including a shield about the dielectric means in conductivity with the grounding terminal means.

* * * * *